United States Patent [19]

Sykes

[11] Patent Number: 5,069,512

[45] Date of Patent: Dec. 3, 1991

[54] DISPLAY CABINETS

[75] Inventor: Christopher C. Sykes, Toronto, Canada

[73] Assignee: Click Systems Limited, Mississauga, Canada

[21] Appl. No.: 344,607

[22] Filed: Apr. 28, 1989

[51] Int. Cl.[5] ..... E06B 00/00

[52] U.S. Cl. ..... 312/139.2; 248/205.3; 49/413; 49/425

[58] Field of Search ..... 312/139.2, 297, 138.1; 248/205.3, 205.4, 208; 49/210, 212, 413, 421, 425, 426, 374, 437, 443

[56] References Cited

U.S. PATENT DOCUMENTS

| | | | |
|---|---|---|---|
| 3,469,348 | 9/1969 | Maiques | 49/413 |
| 3,800,449 | 4/1974 | Minatodani et al. | 248/205.3 |
| 4,548,846 | 10/1985 | Kurtz | 248/205.3 |

FOREIGN PATENT DOCUMENTS

| | | | |
|---|---|---|---|
| 2237395 | 1/1974 | German Democratic Rep. | 49/212 |
| 1325117 | 8/1973 | United Kingdom | 248/205.3 |

*Primary Examiner*—Kenneth J. Dorner
*Assistant Examiner*—Gerald A. Anderson
*Attorney, Agent, or Firm*—Ridout & Maybee

[57] ABSTRACT

A cabinet with a movable glass wall has a double sided foam adhesive tape connecting the glass to a plate forming part of the hinge, slide suspension or other opening and closing linkage. The tape is resiliently compressible and avoids strains tending to damage the glass during opening and closing movements. Cabinets with a plurality of glass sides have extruded edging strips which provide surfaces for bonding to the edges of the glass disposed at 45° to the main surfaces of the strip. The edging strip stiffens and reinforces the glass, allowing the use of thinner glass sheets and provides a convenient means for attaching the sheets together at corners.

15 Claims, 13 Drawing Sheets

DISPLAY CABINETS

The present invention relates to glass cabinet structures.

Glass cabinets are used both in commercial and museum settings to display the objects inside to the fullest possible advantage, while also allowing access to the inside of the cabinet for rearrangement or cleaning of the displayed objects. Hence, retailers and museum curators alike look for similar features in glass display cabinets or cases they intend to utilize. A minimum of non-transparent supports should be employed to maximize visibility of the interior, while still maintaining a sturdy and safe cabinet structure; and the interior of the cabinet should be easily accessible by authorized personnel, while remaining substantially inaccessible to the general public.

With many cabinet structures it is desired to have a glass panel move to an open position revealing an opening in the cabinet for the purposes of access. Usually the movable panel is mounted to a rigid metal part of an opening and closing linkage and known forms of connection to the rigid metal impose strains on the glass panel during opening and closing movements which may result in damage to the glass. Further, with known cabinet structures, especially free standing structures, the glass panels have to be relatively thick and sturdy since the panels are not usually supported except at their lower ends. The need for thick glass panels increases the cost and the weight of the structure as well as making assembly of the structure more difficult because of the unwieldiness of the heavy panels.

The present invention is directed to cabinet structures whereby the above noted problems of known cabinet assemblies may be avoided and in a first aspect provides a cabinet having sides and an opening at the front, a glass panel, and movable linkage means connecting between the sides of the cabinet and the glass panel for movement of the panel between a position closing the opening and a position revealing the opening, said linkage means including a rigid metal planar element bonded on the inner side of the glass panel with a double sided adhesive tape comprising a resiliently compressible core and a pressure sensitive adhesive coating on each face and providing sufficient strength to support the weight of the glass panel.

The invention also provides a rectangular cabinet having a plurality of sides each comprising a glass panel having opposite edges each carrying an extruded edging strip having an inner surface for receiving a side of the edge of the glass panel disposed at an angle of 45° to an outer main surface of the strip and the main surfaces of edging strips on adjacent panels abutting and secured together to retain adjacent sides of the cabinet at 90° angles to one another.

Embodiments of the invention will now be described, by way of example, in association with the accompanying drawings, in which.

Figure 2:
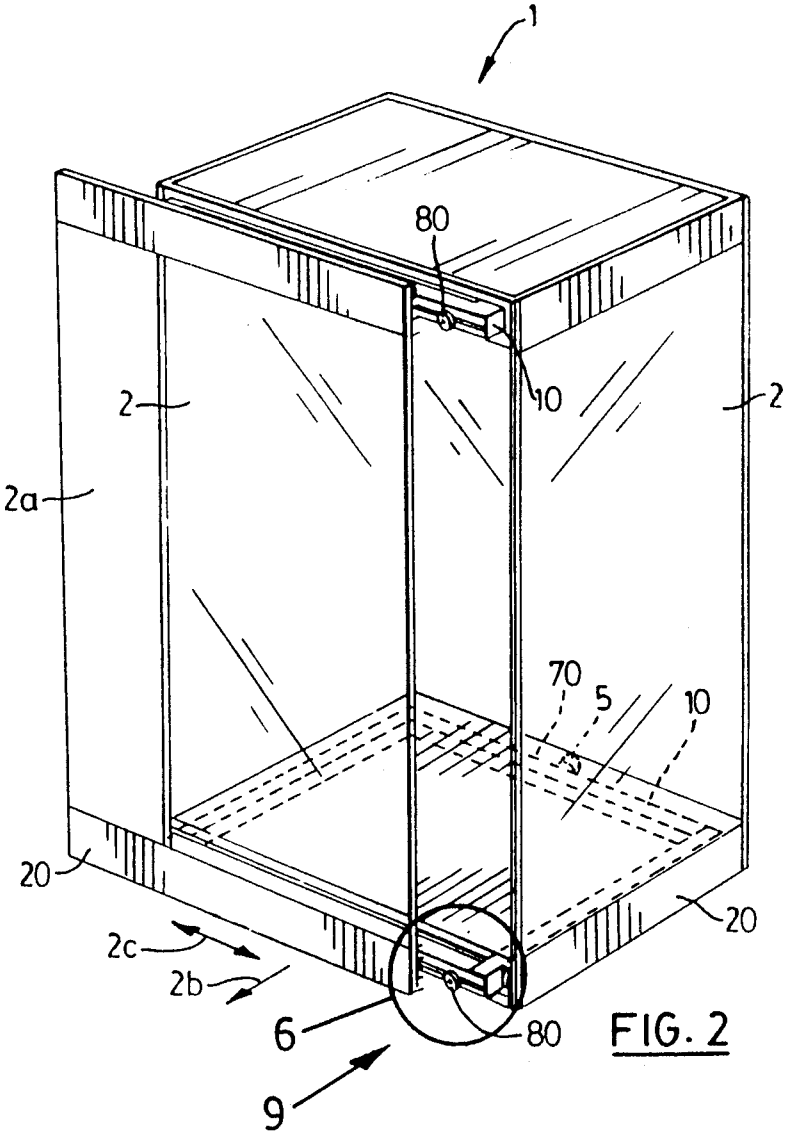
FIG. 2 illustrates the embodiment of FIG. 1 showing the front panel of the cabinet moved outwards and started to move sideways.
Figure 1:
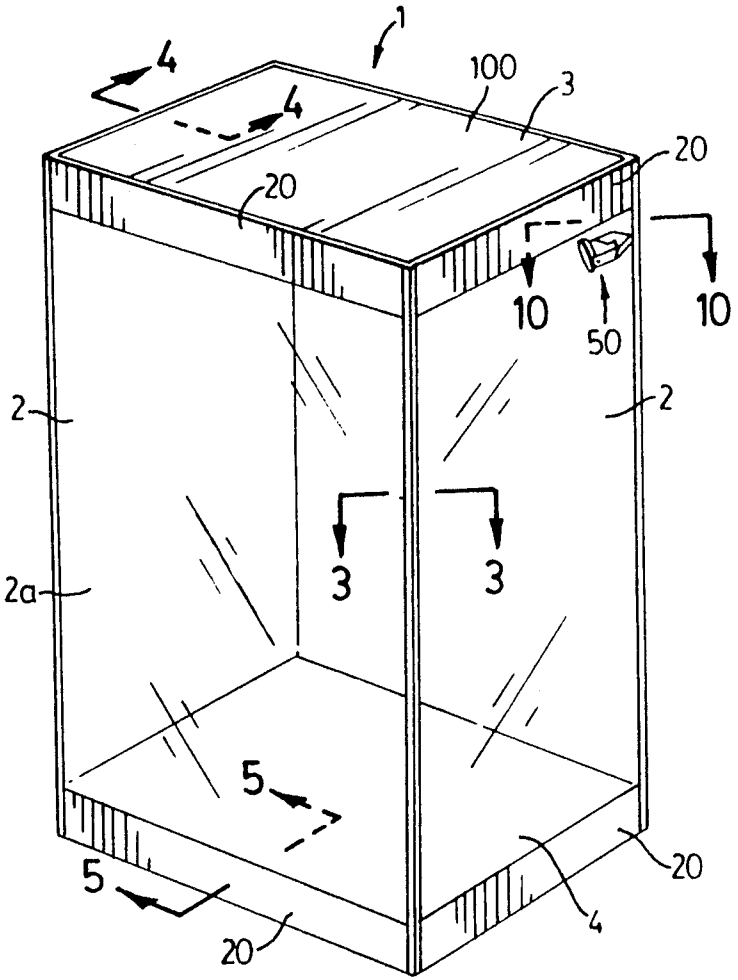
FIG. 1 is a general perspective view of a first embodiment of the invention.
Figure 3:
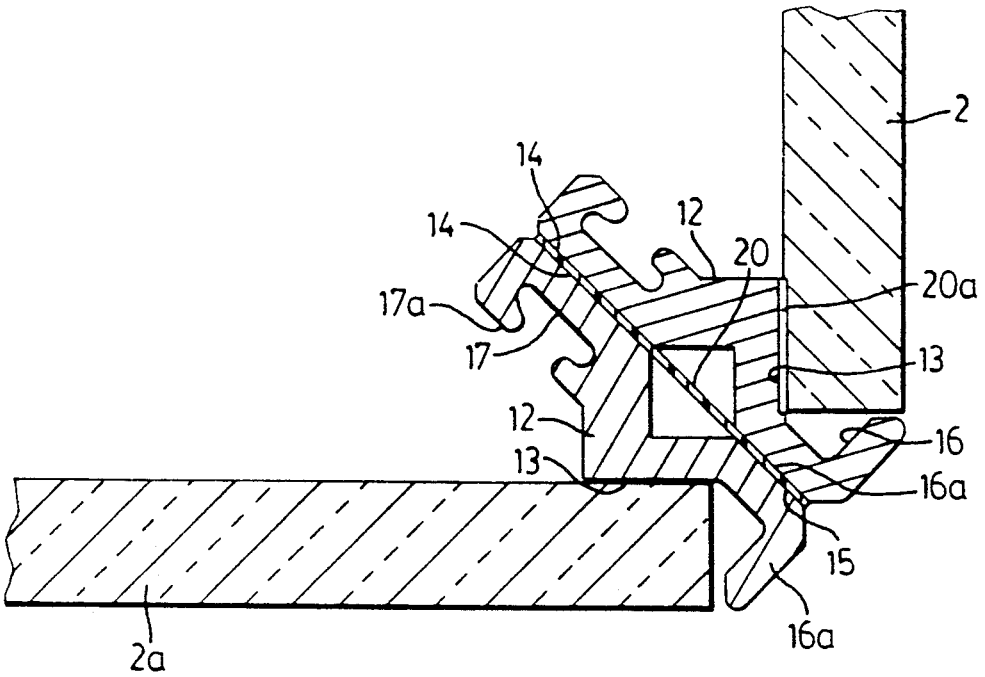
FIG. 3 is a section on line 3—3 of FIG. 1 showing a typical corner arrangement of support extrusions bonded to the glass on one wall of the cabinet.
Figure 7:
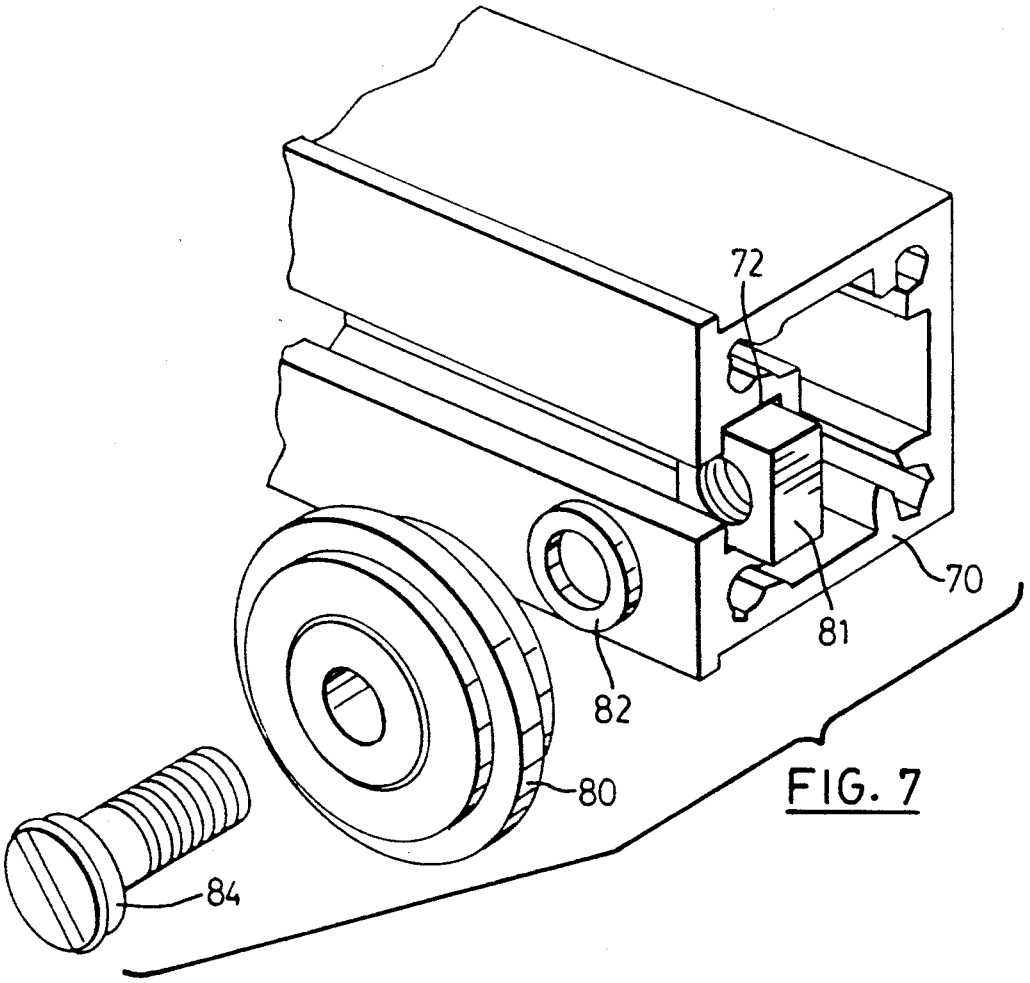
Figure 4:
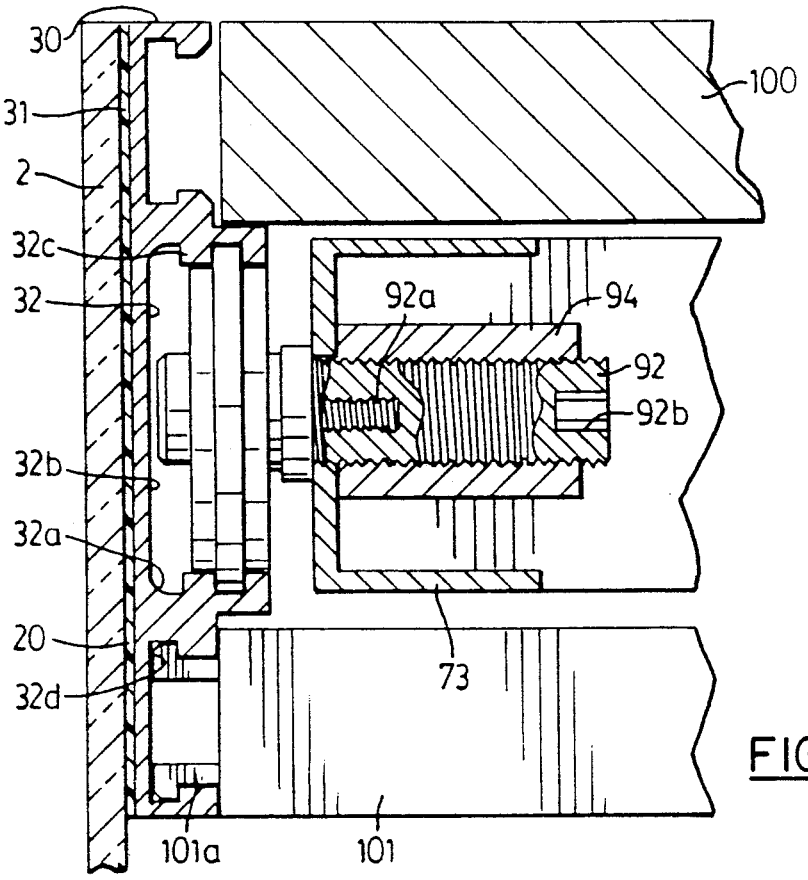
FIG. 4 is a section on line 4—4 of FIG. 1 showing the extension means at the top base frame for sliding the front panel outwardly.
Figure 6:
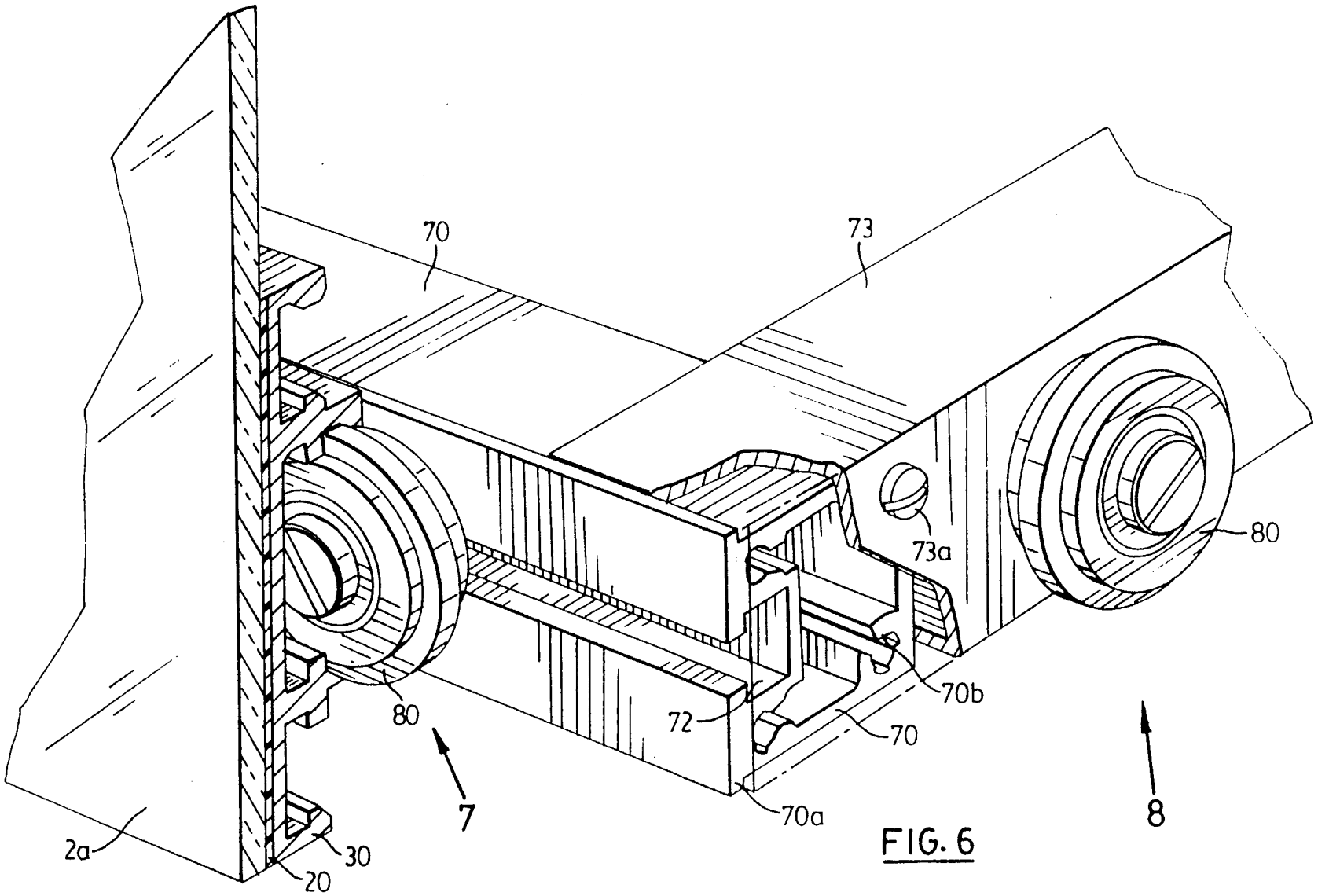
FIG. 6 is a detail perspective view of area "6" of FIG. 2 enlarged.
Figure 8:
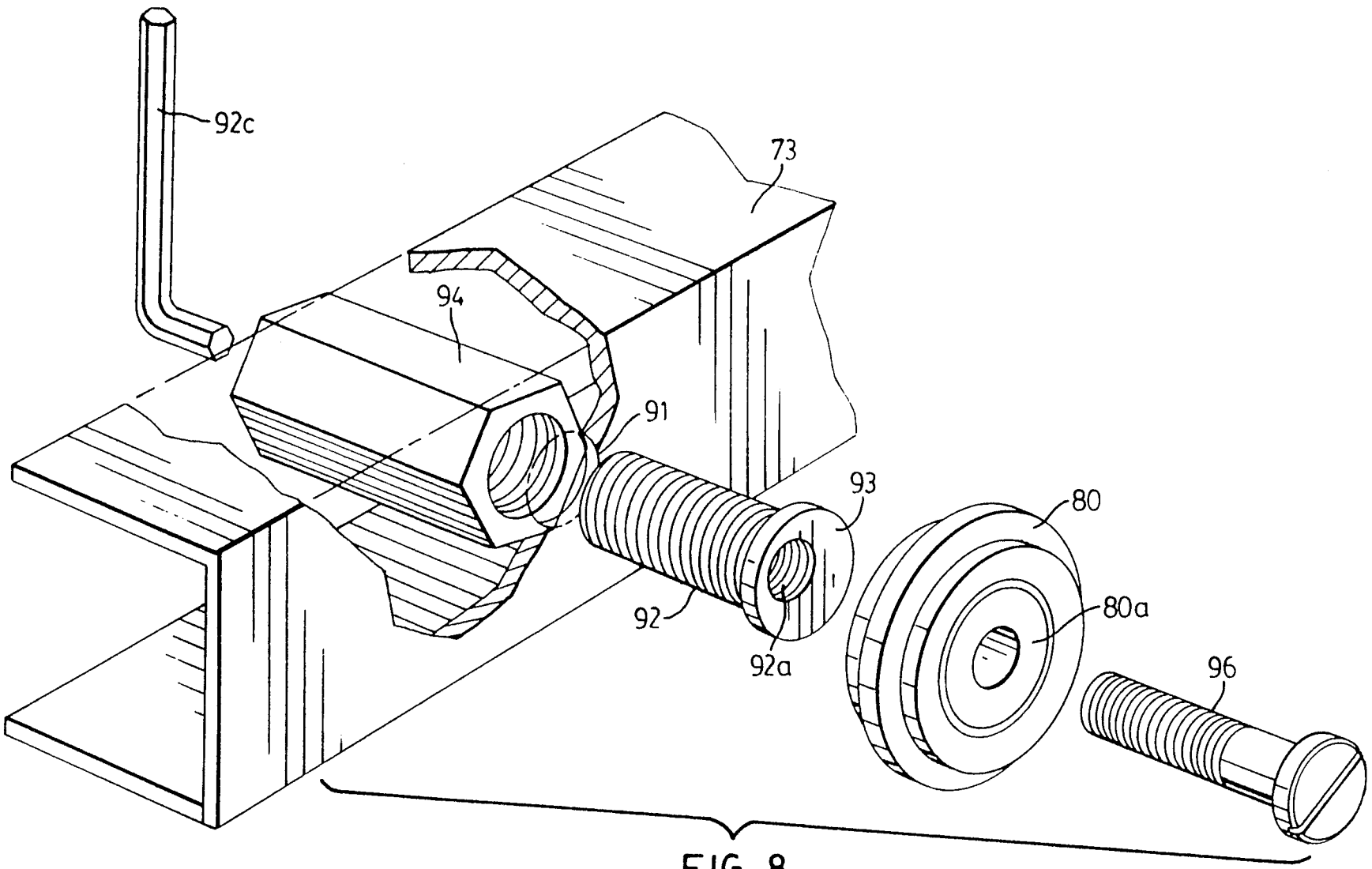
Figure 10:
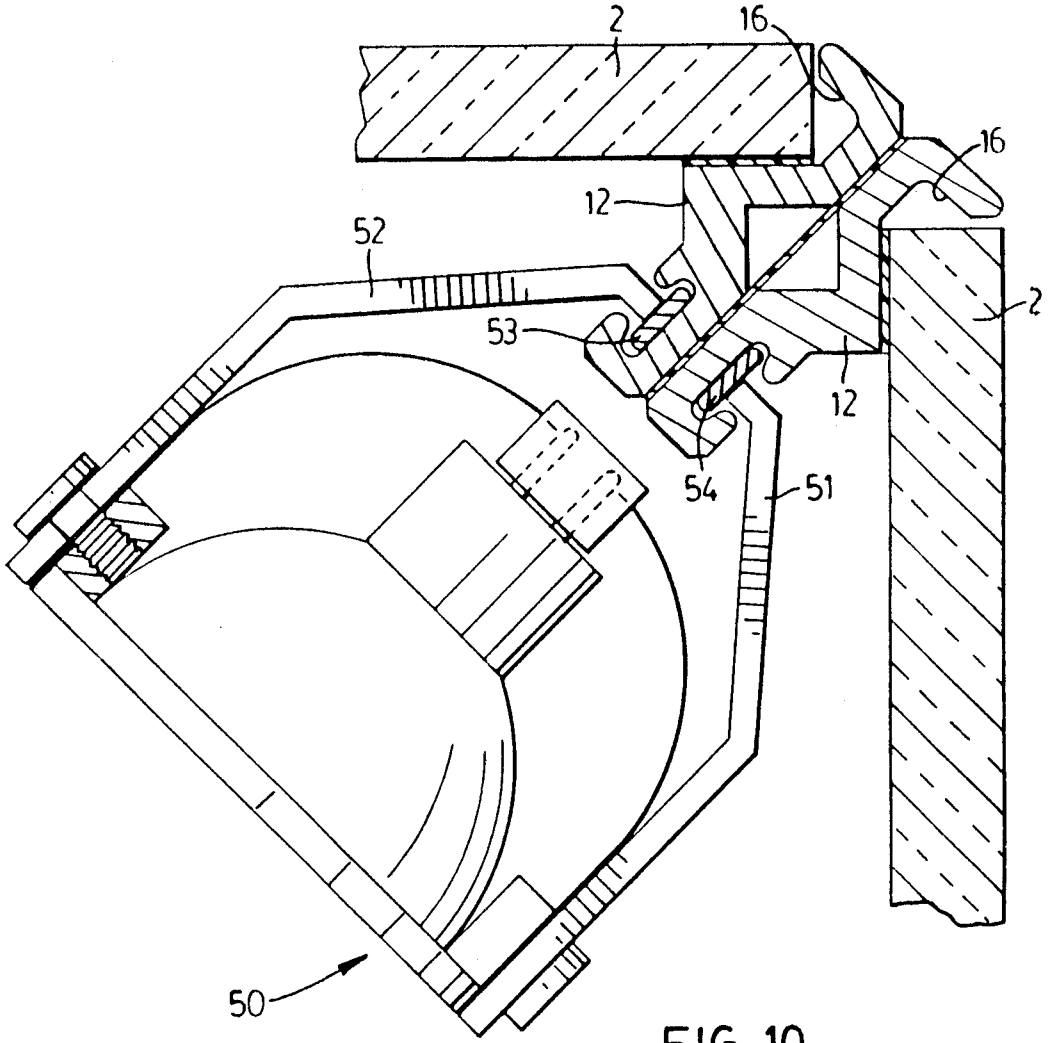
Figure 9:
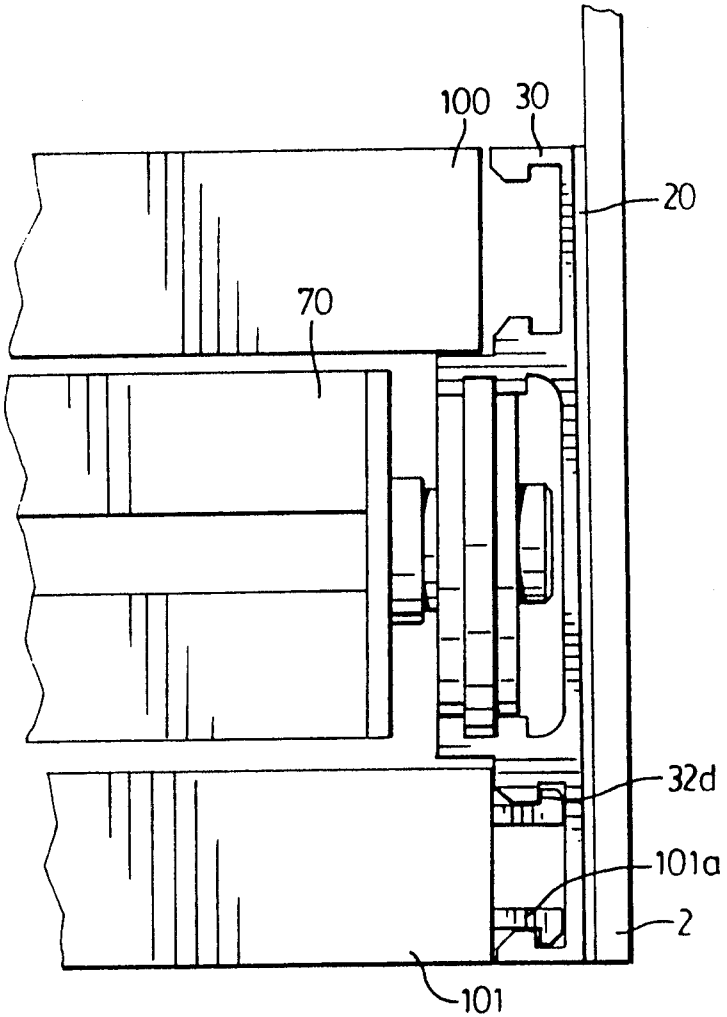
Figure 12:
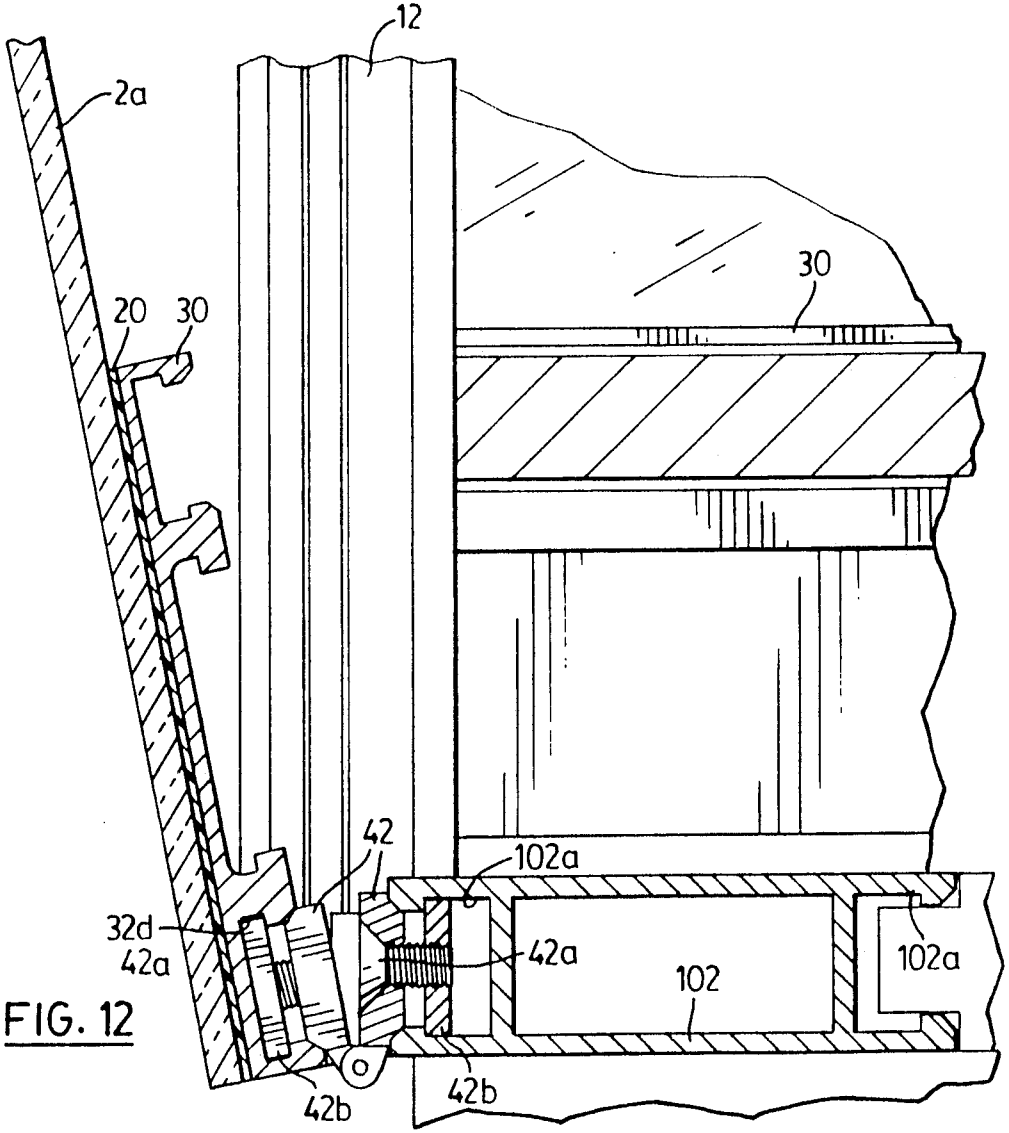
Figure 11:
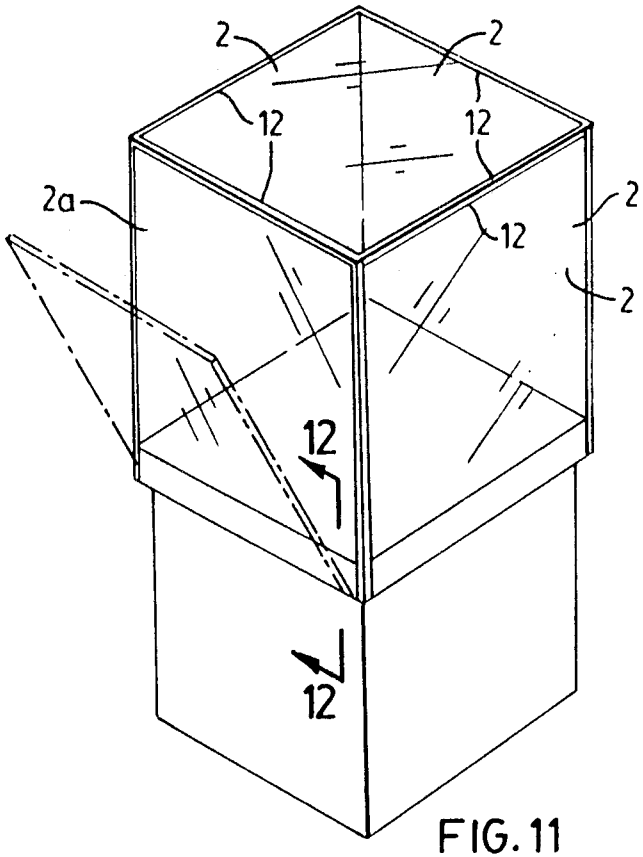
Figure 14:
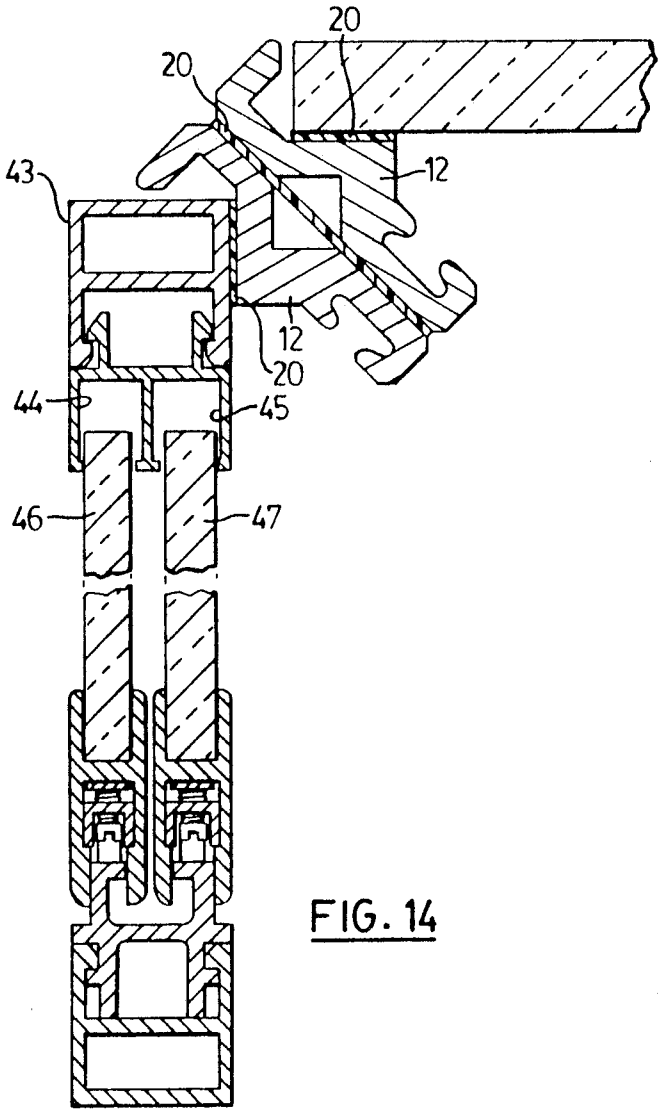
Figure 13:
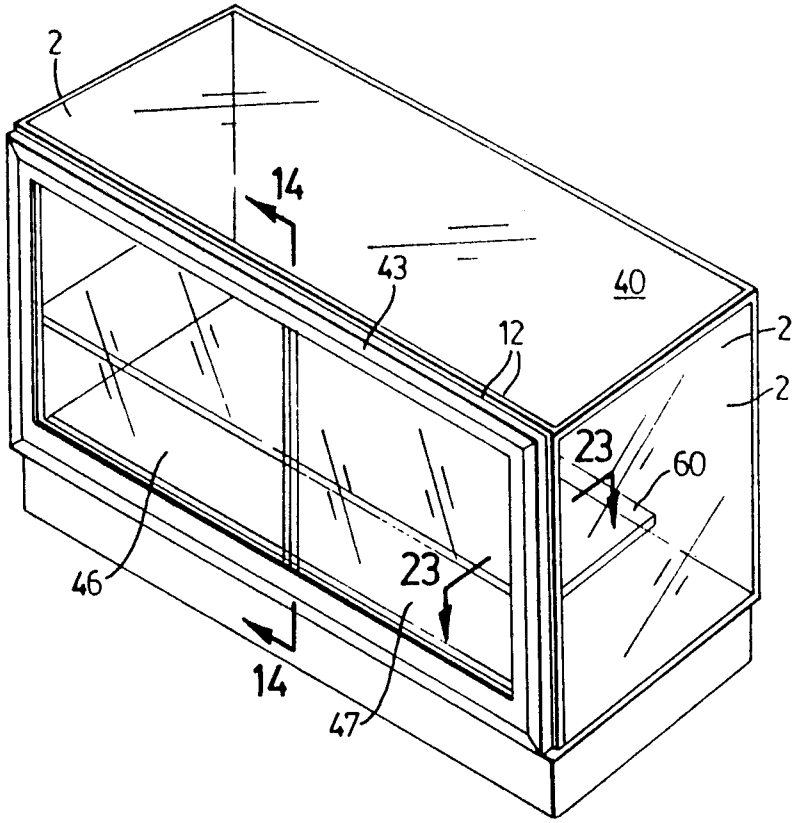
Figure 16:
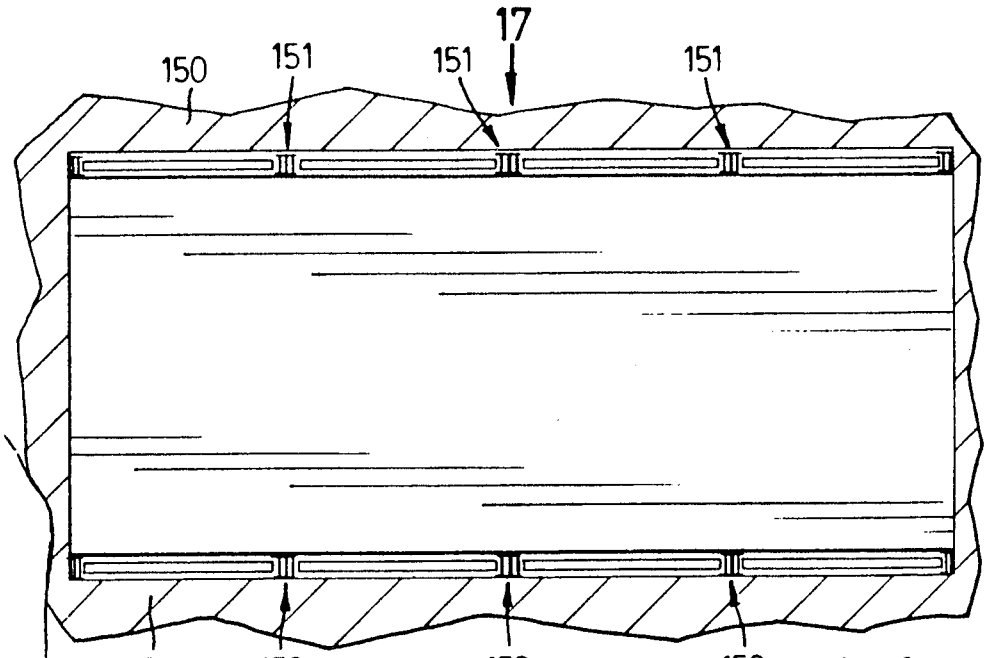
Figure 17:
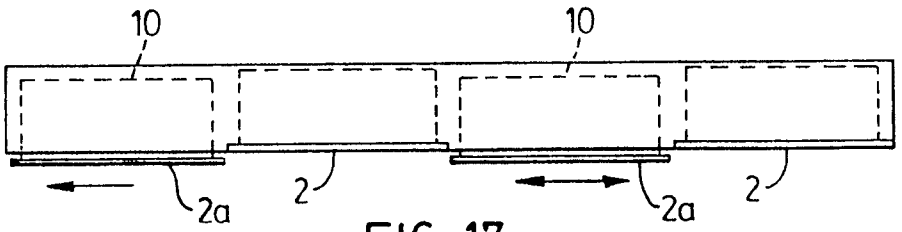
Figure 15:
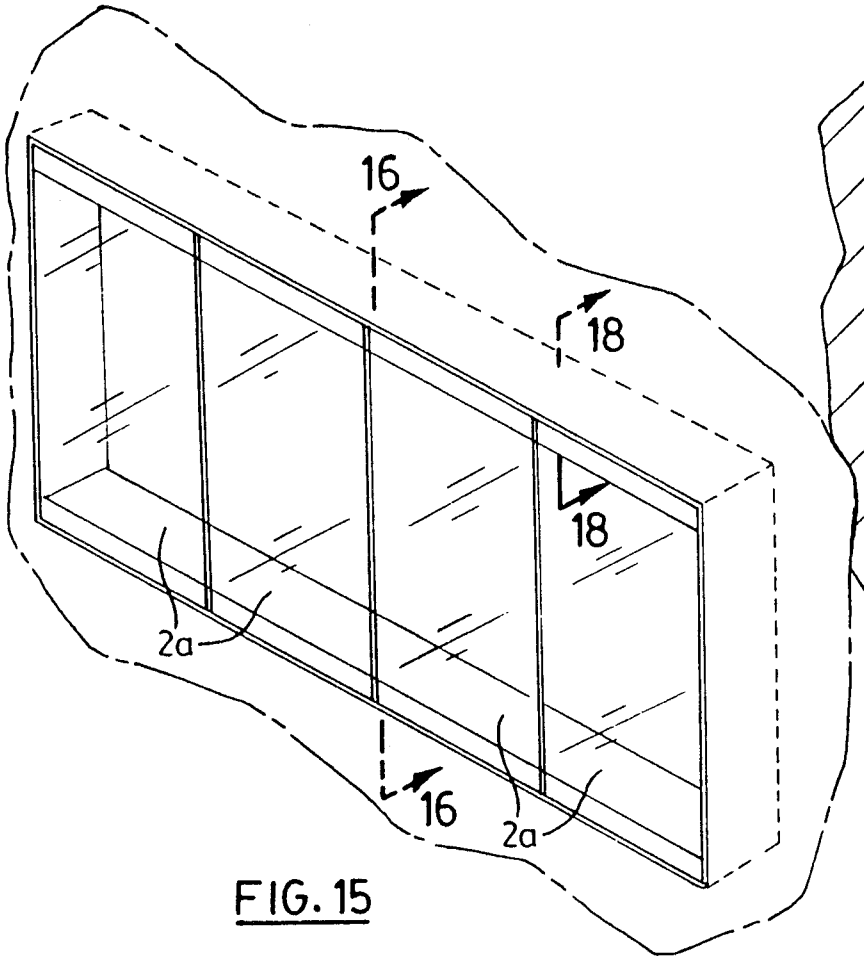
Figure 19:
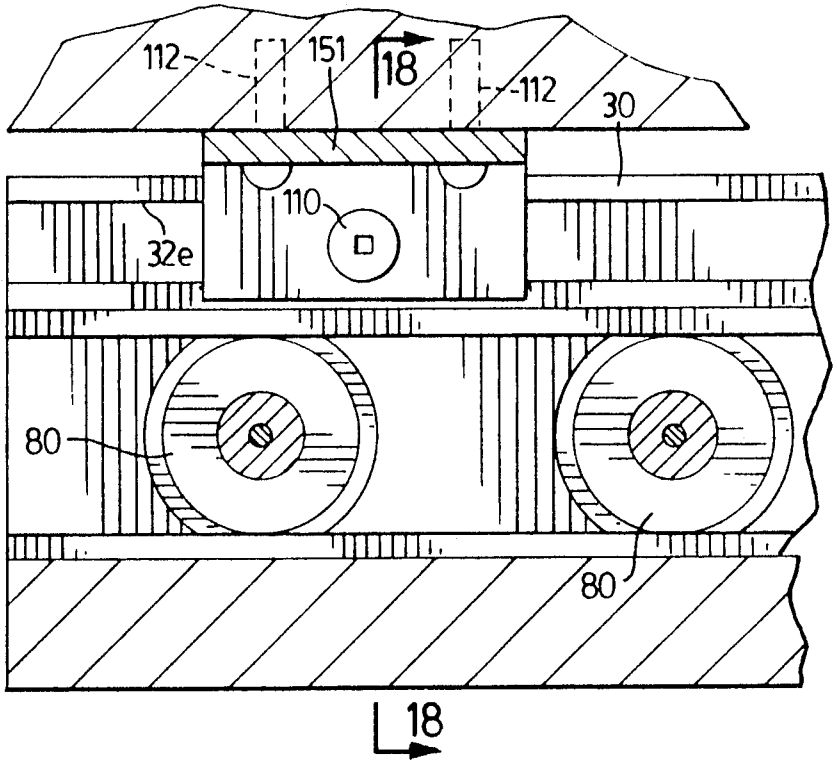
Figure 18:
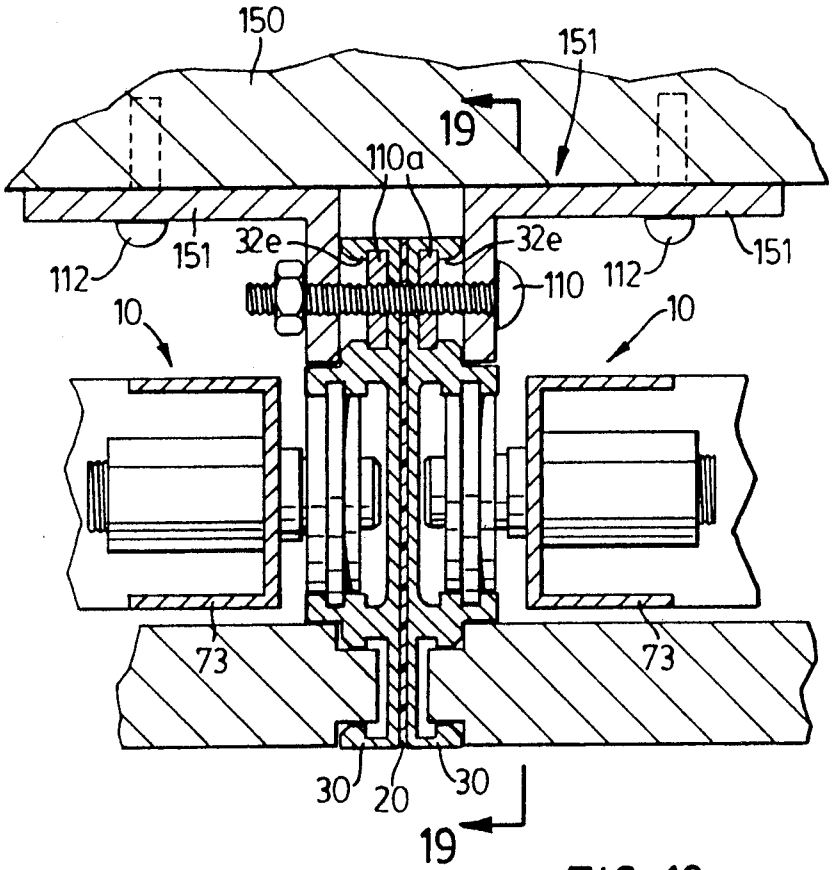
Figure 21:
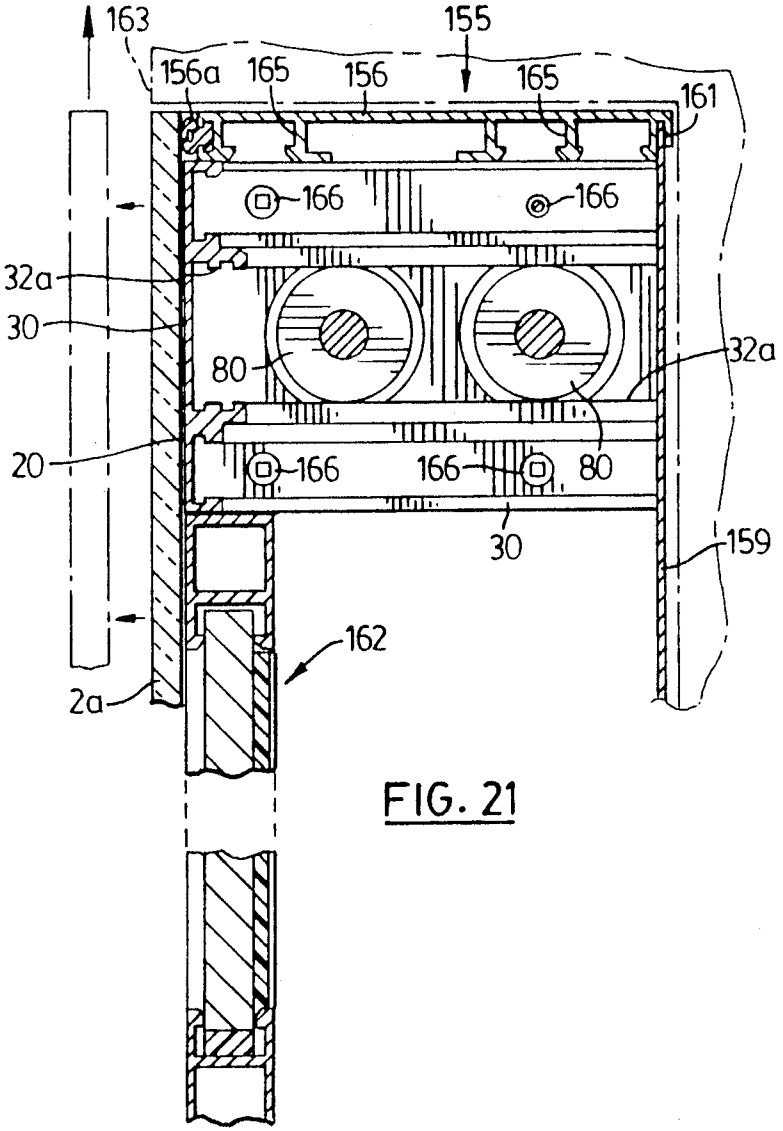
Figure 20:
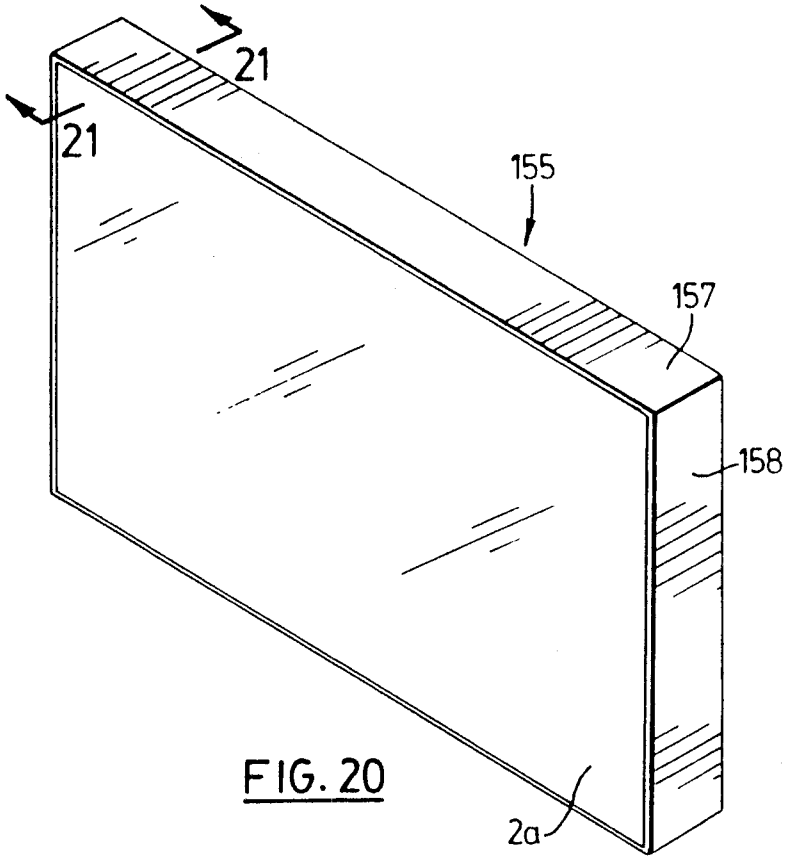
Figure 23:
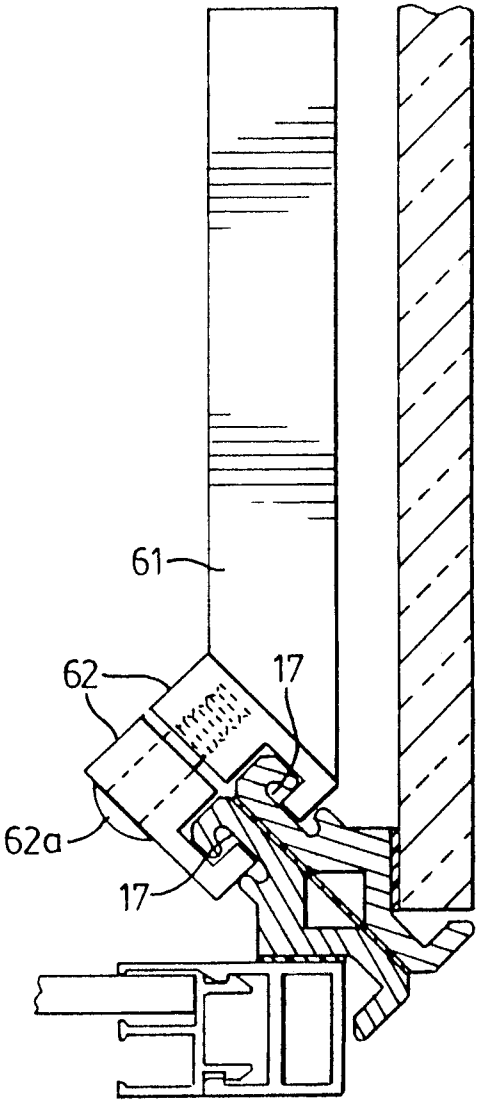
Figure 22:
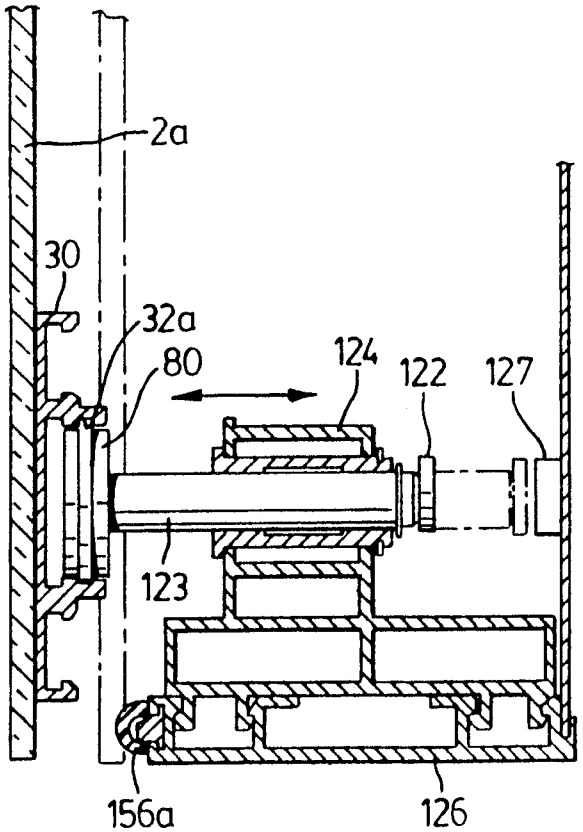
Figure 24:
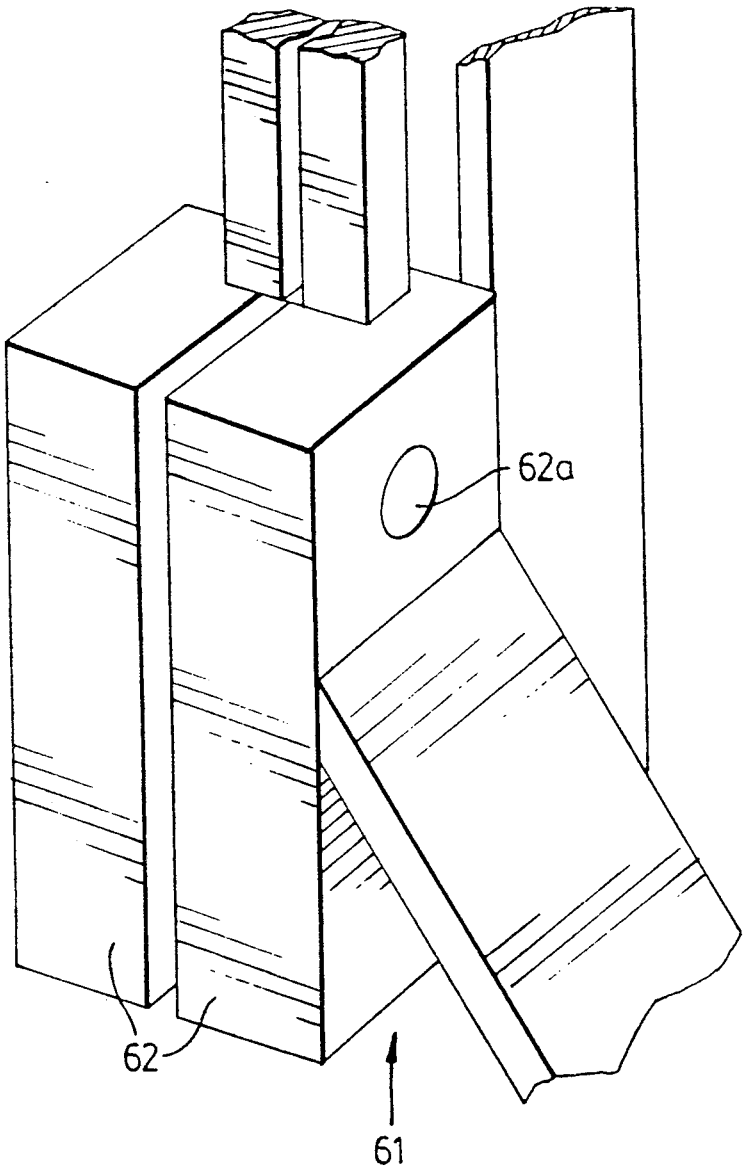

FIG. 7, which appears on the same page with FIG. 3, is an exploded perspective view of the area at arrow 7 in FIG. 6;

FIG. 8 is an exploded perspective view of the area at arrow 8 in FIG. 6;

FIG. 9 is a view on arrow 9 of the embodiment of FIG. 2 of the bottom base frame, including the extension means for sliding the front panel outwardly;

FIG. 10 is a section on line 10—10 of FIG. 1 showing a typical corner arrangement of support extrusions bonded to the glass on two walls of the cabinet, and includes a typical lamp clamped in place on the extrusion;

FIG. 11 illustrates a second embodiment of the free-standing unit, according to the invention, with a hinged front panel;

FIG. 12 is a section on line 12—12 of FIG. 11 showing a detail of the hinge arrangement;

FIG. 13 illustrates a third embodiment, according to the invention, showing an overlapping sliding door arrangement;

FIG. 14 is a shortened section on line 14—14 of FIG. 13 showing a typical corner extrusion bonded to glass walls on two sides at the top of the cabinet, and showing a slide channel arrangement of the overlapping doors;

FIG. 15 illustrates a fourth embodiment, according to the invention, utilizing a multiple front sliding panel arrangement;

FIG. 16 is a section on line 16—16 of FIG. 15 showing a schematic view with four sets of chassis or sliding modules;

FIG. 17 is a view on arrow 17 of FIG. 16 showing a schematic view of alternate doors extended outward and sliding;

FIG. 18 is a section on line 18—18 of FIG. 15 showing a detail of the two-sided extension means for sliding the front panels outwardly of adjacent modules;

FIG. 19 is a side view on line 19—19 of the detail shown in FIG. 18;

FIG. 20 is a general perspective view of a fifth embodiment of the invention, a directory board with an outside glass front panel;

FIG. 21 is a shortened section on line 21—21 of FIG. 20 of the frame, including the slide mechanism at the top of the frame;

FIG. 22 illustrates an alternate slide arrangement to that shown in FIGS. 4, 16 and 18;

FIG. 23 is a section on line 23—23 of FIG. 13 showing a clamp and shelf support arrangement on a typical corner extrusion structure, according to the invention; and FIG. 24 is a perspective detail view of the clamping arrangement of FIG. 23.

Referring now to FIG. 1, in a first embodiment, the invention is directed to a free-standing glass display cabinet 1 having three fixed glass panel walls, generally designated by 2, a movable front wall 2*a* and opaque panelled top and bottom bases 3 and 4.

As shown in dotted outline in FIG. 2, each of the top and bottom bases has associated with it a forwardly and rearwardly slidable rectangular slide assembly 10, comprised of extruded aluminum struts. The specific configuration of these struts will be discussed below in relation to the mechanisms illustrated in FIGS. 4 and 5.

Associated with the panels 2 and 2*a* are eight vertical extruded aluminum edge strips 12, the preferred profile of which is shown in cross-section in FIG. 3.

Each strip 12 has an inner surface 13 formed at an angle of 45° to the main surfaces 14 and 15 of the strip. One end 16*a* of the strip extends transversely to form a recess 16. At the other end, the strip 12 forms a channel 17 with re-entrant lips 17*a* on the inner side of the strip.

As shown in FIG. 3, the edge strips 12 are preferably bonded securely together in pairs to form the corners of the cabinet, using a double-sided adhesive tape 20. It is preferred that the tape comprises a core layer of resiliently compressible material preferably acrylic foam which has been found to offer superior mechanical and light resistant properties, so that the cabinet structure is strong, does not deteriorate on prolonged exposure to light, and is not excessively rigid, and it has been found that 3M's acrylic based VHB tape works very well for this purpose. Preferably the tape is 3M Scotch Tape Y-4930 (black) which is closed cell acrylic foam coated on each side with pressure sensitive adhesive.

Lengths 20*a* of the same double-sided adhesive tape 20 are also used for bonding an edge strip 12 to each side of the fixed glass panels 2 forming the side walls and back of the cabinet. The panel 2*a* is unbonded and merely seats on the inner surface 13 of each adjacent strip 12.

As shown in FIG. 10, the adhesive tape 20 is used to bond the edge strips 12 of both abutting panels of glass 2 together to form the two rear corners of the cabinet, the recess 16 of each edge strip serving both to protect the edge of the adjacent glass sheet 2 and to protect the fingers of those handling the glass sheets. The main function of the strips 12 however is to stiffen and reinforce the glass sheets, allowing thinner sheets than heretofore to be used. The strips 12 also provide a convenient means of attaching the sheets together at the corners of the cabinet. Instead of using the adhesive tape 20, mechanical fasteners may be used to connect adjoining strips 12 together, for example clamping members as described below in more detail with reference to FIGS. 23 and 24. The extruded strip 12 has a rectangular indentation 12*a* in its outer side, the edges of the indentation being parallel to and at 90°, respectively, to the face 13, facilitating clamping of the strip to the edge of the glass using jigs or clamps during bonding of the glass to the strips 12.

In the first embodiment of the invention shown in FIGS. 1 and 2, upper and lower transverse base frames connect the panels 2*a* together and support the slide assemblies 10 and each comprises three extruded rigid metal planar elements 30 bordering the upper and lower edges of each glass wall 2.

As shown in FIG. 4, each element 30 is in the form of a length of aluminum extrusion with a flat outward facing surface 31 and a channelled inward facing surface 32. The outward facing surface 31 is bonded to the inner face of the glass panel 2 using lengths of the adhesive tape 20. It is these lengths of tape 20 that are visible from the exterior side of the cabinet at its upper and lower ends, as seen in FIGS. 1 and 2.

The above mentioned preferred tape is readily capable of supporting heavy glass panels in engagement on the elements 30.

The elements 30 attached to the two side glass panels 2 are connected to the element 30 attached to the third or back glass panel 2 by an angle bracket (not shown) one arm of which is inserted into each central channel 32*a*. A threaded member e.g. a screw is passed through each arm and reacts to compress the arm against the inner side of the re-entrant lips 32*c* of the channel.

Figure 5:
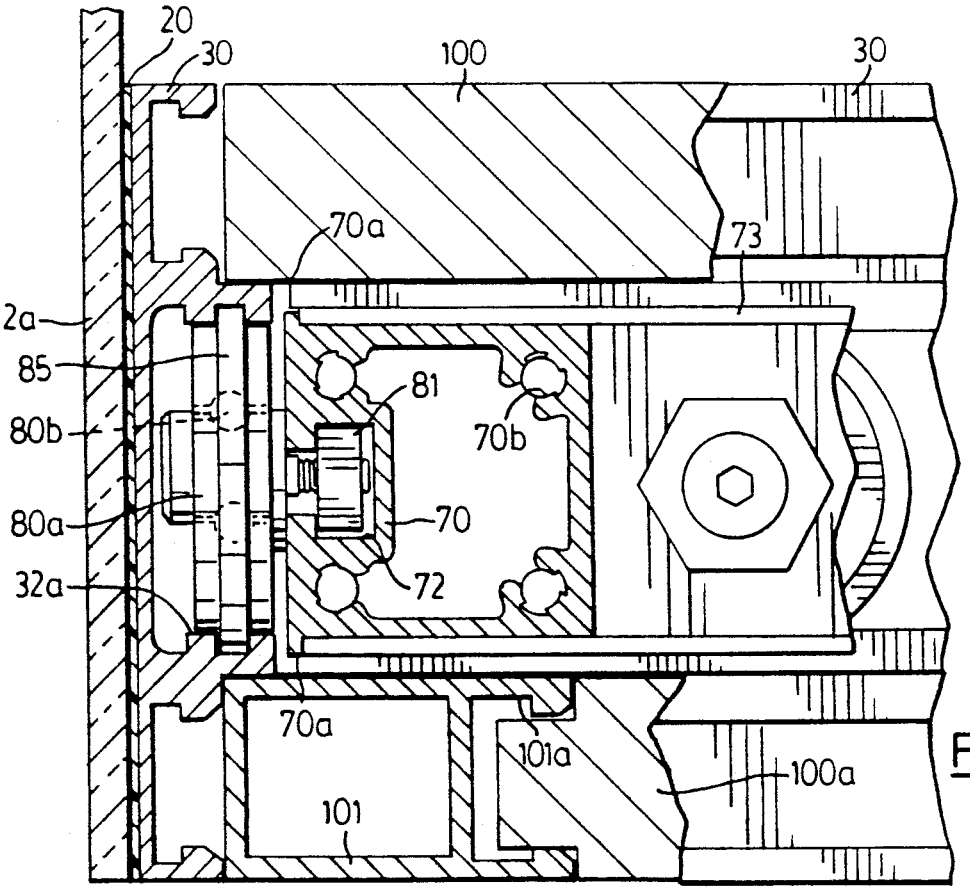
FIG. 5 is a section on line 5—5 of FIG. 1 showing the means at the bottom base frame for sliding the front panel sideways.

The forward ends of each side elements 30 are tied to one another and maintained spaced securely apart by a box section rail 101 having a channel section on one side as seen in cross-section in FIG. 5 and as seen in FIG. 9 having ears 101*a* expansible by a screw threaded member (not shown), which ears lock into a lower side channel 32*d* having re-entrant lips formed on the plate member 30. As seen in FIG. 4, a similar rail 101 having ears 101*a* may be used to connect between and brace apart the rearward ends of the side elements 30.

As seen in FIGS. 5 and 6, the movable glass panel 2*a* has a planar rigid element 30 attached by the double sided compressible tape 20 to its upper and lower margins.

As seen in more detail in FIGS. 4 to 8, each slide assembly 10 consists of two channel section side pieces 73 and front and rear transversely extending box-section members 70 each having a channel 72 with re-entrant lips. Each also has upper and lower protruding flanges 70*a* at the outer side, against which the ends of the side pieces 73 abut. Internally, the box-section member is formed with part circular section channels 70*b* with raised portions adapted to receive self tapping screws 73*a* passed through apertures in the walls of the pieces 73 and thus connecting pieces 73 securely on the members 70.

Two rollers 80 are journalled on each side piece 73 adjacent the front and rear, respectively. The rollers 80 having a rectangular profile tread captured in and riding rollingly in rectangular edge channels formed in the central channels 32*a*. The axle of the foremost roller 80, seen in FIGS. 4, 5, 6 and 8 is adjustably mounted in the side piece 73. Since normally the assembly 10 cannot be withdrawn sufficiently from the cabinet to expose the outer side of the roller 80, an arrangement is provided for adjustment from the inner side. An externally threaded cylinder 92 with an enlarged head 93 passes rotatably through an opening 91 in the piece 73. A blind threaded bore 92*a* is formed eccentrically in the end of the cylinder 92 and receives a threaded stud 96 securing the hub 80*a* of the roller 80 on the head 93. The cylinder 92 passes through and is threaded within a bore in an elongate nut 94, compressing the side wall of the piece 73 between one end of the nut 94 and the head 93. The opposite end of the nut 94 extends rearwardly sufficiently beyond the side piece 73, as seen in FIG. 4, so that it can be engaged with a wrench. A hexagonal recess 92*b* is broached in the end of the cylinder 92 to receive a hex key 92*c*. By engaging the hex key in the recess 94*a* and rotating the nut 94 with a wrench, the engagement with the side piece 73 can be loosened. The hex key 92*c* can then be used to rotate the cylinder 92, adjusting the elevation of the bore 92*a* and the roller 80 relative to the side piece 73. Thus, the front of the slide assembly 10 can be pivoted up and down about the axis of the rearmost roller 80.

As seen in FIGS. 6 and 7, a number of rollers 80 are mounted in the front channel 72 of the member 70 and roll in captive fashion within the central channel 32*a* of the adjacent element 30 attached to the movable panel 2*a* as seen in FIG. 5. A square nut 81 is inserted into the channel 72 to the location where the roller is to be mounted. Washer 82 and roller 80 are then aligned with the nut 81, and an axial bolt 84 threaded through.

Each roller 80 is a conventional form of wheel comprising as seen in FIG. 5 a nylon tread 85 mounted on a metal race running on balls 80 running on a metal race provided on the hub 80*a*. The ball bearing allows a slight lateral pivot of the tread 85 relative to the axis of the nut 80*a*.

In use, even where the movable panel 2*a* is of substantial size, for example longer than a normal arm span, the cabinet can be opened relatively easily by pulling on one edge of the glass, for example the lower edge. Since the upper and lower assemblies 20 slide independently, the lower edge of the panel 2*a* and the lower assembly 10 can be extended first a small distance, the rocking of the wheels 80 about their hubs 80*a* allowing pivoting of the panel 2*a* about the axis of the front edge of the upper assembly 80 to an inclined position. The resiliently compressible foam layer 20 between the panel 2*a* and the planar rigid elements 30 contributes to the ability of the panel 2*a* to pivot without applying strains likely to damage the panel 2*a*. The upper edge of the panel 2*a* can then be grasped and the upper edge of the panel rocked outwardly by causing forward extension of the upper sliding assembly 20 relative to the side walls of the cabinet. When the front panel 2*a* has been brought to a vertical forward position as shown in FIG. 2 and as indicated by the arrow 2*b* in FIG. 2, in which panel 2*a* is clear of the ends of the side panels 2, it can be slid laterally as indicated by the arrow 2*c* in FIG. 2 along the rollers 80 supported on the front members of the sliding assemblies 20, in order to reveal the opening in the cabinet.

Stops are provided to prevent over extension of the assemblies 10 from the cabinet and to limit lateral sliding of the panel 2*a* beyond extreme limits.

A rod (not shown) may be connected to the inner side of each rigid planar element 30 connected to the back wall of the cabinet, the rod passing freely forwardly through apertures in the rear member 70 of the adjacent assembly 10. Nuts are threaded on the rod, on opposite sides of the member 70. The front and rear faces of the member 70 then engage the adjacent nuts at extremes of travel of the assembly 10. Stop arrangements conventionally used for sliding suspensions may be used to limit lateral movement of the panel 2.

During assembly of the cabinet, the assemblies 10 may be pivoted up or down by adjusting the elevation of their foremost rollers on each side, as described in more detail above, so that in the closed position the panel 2*a* seats perfectly in the correct position on the inner edges 13 of the front edge strips 12.

As seen in FIG. 2, a pair of mutually attractive magnets 5 may be attached to the rear of the member 70 and to the rear wall of the cabinet in order to bias the assemblies 10 to the closed position.

To close the upper end and lower interior ends of the cabinet, panels 100 may be lodged on or attached to the upper sides of the planar elements 30. A second lower panel 100*a* engaging the channels 101*a* of the rails 101 may close the lower side.

FIGS. 11 and 12 show a cabinet with three fixed glass sides and a fixed glass top 2. Each side piece of glass has the edging strip 12 as shown in FIG. 3 bonded to its vertical sides and along its top edge and the top sheet of glass has edging strip 12 bonded to all four edges. The corners of the edging strip 12 may be mitred. Adjacent fixed panels are connected together with the above-described double sided tape applied between the major faces 14 and 15 of adjacent strips 12.

The cabinet has a lower frame formed of planar elements 30 adhered with double sided tape to the lower margins of the fixed vertical panels 2 and connected with angle brackets and rails 102 similar to those described above with reference to FIGS. 4 and 5. In this case, however the rail 102 has a channel section 102*a* with re-entrant lips on each side of the rail 102. Similarly, an element 30 is bonded to the lower margin of movable panel 2*a*.

At the front of the cabinet, the mounting of front panel 2*a* comprises a hinge or a row of hinges 42 extending substantially the width of panel 2*a*, which allows the panel to be swung forwardly downwardly open. Opposite portions of the hinge are anchored using threaded members 2*a* engaging apertured plates 42*b* engaging in the channels 32*d* and 102*a*, respectively. The layer of foam 20 cushions the glass 2*a* against strains imposed between it and the element 30 on opening and closing movement.

In the embodiment illustrated in FIGS. 13 and 14, horizontally disposed pairs of edge strips 12 are bonded to the glass walls 2 and top 40 on three sides of a cabinet. The front face of the cabinet employs a conventional form of sliding door arrangement illustrated in shortened cross-section in FIG. 14.

An extruded aluminum frame 43, is bonded with adhesive tape 20 to the edge strip frame 12 of the cabinet, and provides parallel running channels 44 and 45 for receiving sliding glass panel doors 46 and 47 in overlapping arrangement.

The channels 17 of the edge strips 12, shown in FIG. 3, permits shelves, lighting elements and the like to be suspended inside the cabinets with a minimum of visible supports and connections.

As illustrated in FIG. 10, a conventional low voltage lighting element 50 may be securely mounted by providing clamps 51 and 52 engageable in the opposite channels 17 of a bonded pair of edge strips 12. One advantage of this arrangement over known arrangements is the elimination of unsightly electrical cords connecting the lighting element 50 to a power source. According to the invention, thin copper ribbon 53 and 54, connected across a lower D.C. voltage source, e.g. 12 volts D.C., extend the length of each channel 17. The circuit is completed through the metallic clamping arms 51 and 52 at the light source itself. The ribbons 53 and 54 are bare and are insulated because of the naturally occurring oxide film on the aluminium. The insulation is enhanced if the aluminium edge strips 12 are anodised.

As shown in FIG. 13, shelves 60 may be suspended, with minimum visible supports, inside the cabinet. The shelf is supported on opposite sides by a cantilever bracket 61 shown in perspective in FIG. 24. Each bracket 61 is secured onto a pair of edge strips 12 by a clamp 62, which is internally threaded and tightened by bolt 62*a*. The ends of the clamp as seen in FIG. 23 locate in the channels 17.

The bracket 61 extends horizontally at a 45° angle from the clamp 62, that is parallel to and immediately adjacent the side glass wall 2 of the cabinet, in order to minimize its visibility inside the cabinet.

In the embodiment of the invention shown in FIGS. 15 to 19, a series of sliding assemblies similar to the assemblies 10 described above are connected together in the manner illustrated in FIGS. 18 and 19, to form a cabinet of indefinite length which may be situated in an alcove or the like.

As can be seen from FIG. 18, short lengths of the planar elements 30 of adjacent modules may be bonded together using adhesive tape 20, and are suspended from a ceiling 150 with a suspension unit 152 comprising a bolt 110 passed through holes formed in plates 110*a* received in upper channels 32*e* and secured with nut 111. Angle brackets 151 bolted with bolts 112 to ceiling 150 support the bolt 110. Floor units 152 similar to units 151 support planar elements 30 in similar fashion above a floor 153. In this arrangement, adjacent front panels 2*a* of the long cabinet may be slid forwardly and laterally open in the manner described above. Alternatively as indicated in FIG. 17 every other front panel 3*a* may be movable, intervening panels 2 being fixed.

In FIG. 20, a directory board cabinet 155, to be mounted into a preprepared alcove in a building wall, for example in an office building lobby is shown.

As shown in FIG. 21, a rigid aluminium extrusion 156 having multiple channels with re-entrant lips on its inner side, is used in lengths to form the top 157, bottom, and sides 158 of the cabinet. A plate 159 received in an edge channel 161 forms the back. Angle brackets and screws may interconnect the top, sides and bottom.

The directory board itself, 162, is mounted within the cabinet. A rectangular sheet of glass 2*a* movably closes the front, and, as shown in FIG. 21 is preferably arranged so that in the closed position its outer side is flush with the building wall 163 so that there are no edges which can be gripped by the fingers to pry the glass 2*a* open.

Upper and lower planar elements 30 are bonded to the inside of the glass 2*a* with double sided adhesive tape as described above.

A short length of the planar element extrusion 30 is attached on the inner face of each side and extends horizontally, adjacent the top and the bottom of the cabinet.

A slide assembly similar to the slide assembly 10 described above connects each side planar element 30 to the adjacent front planar element 30, with rollers 80 supported on the side pieces of the slide assembly rolling in captive fashion within the central channel 32*a* of the side element 30 and rollers (not shown) supported on the transverse member of the slide assembly rolling in captive fashion within the channel 32*a* of the element 30 attached to the inner side of the glass.

A detent, for example a magnetic catch similar to the magnetic catch 5 described above, may be used to maintain the sliding assembly and glass 2*a* normally in the closed position.

This directory board is thus rendered tamper resistant, since there is no external locking mechanism. It may be opened by applying suction caps to the glass 2*a* to pull it forward and slide it laterally within the limits allowed by the stops limiting movement of the slide assemblies relative to the cabinet and of the former relative to the glass 2*a*.

Normally, with the directory board arrangement illustrated access to the inner side of the slide assembly is difficult. The axes of the rollers 80 are fixed relative to the side pieces of the slide assembly, without means for adjusting their elevation relative to the side pieces. To allow for vertical adjustment, the short lengths of the side planar elements 30 are preferably adjustable in position relative to the sides 158.

Preferably, blocks (not shown) with threaded apertures in them are captive in channels 165 provided in the extrusion 156 forming the sides 158. Screws 166 are passed through apertures in the planar element 30 compressing the blocks inwardly against the re-entrant lips of the channels 165, similar to the arrangement of threaded members 42*a* and plates 42*b* shown in FIG. 12. Hence, on loosening the screws 166, the position of the planar elements 30 can be adjusted to ensure a perfect fit of the glass 2*a* on the front face of the directory board.

A compressible elastomer gasket 156*a* may be supported around the front edge of the cabinet 155, rendering the cabinet dust-tight in the closed position.

An alternative slide mechanism is illustrated in FIG. 22. In FIG. 22 it is shown supporting the lower edge of glass 2*a* in a directory board similar to that described above with reference to FIGS. 20 and 21. It should be pointed out, however, that this alternate slide arrangement is not limited in application to the embodiment of the invention shown in FIGS. 20*f* and 21, but may be substituted, with modification, in any of the above described embodiments.

As shown in FIG. 22, a roller 80 may be mounted at the end of a shaft 123, supported slidably in a bushing 124 connected inside channels of an extrusion 126, lengths of which form the sides of the cabinet. Preferably, shaft 123 is maintained normally toward the rear wall of the cabinet, for example with an internal spring, or by mounting magnets 127 on the rear wall of the cabinet and on the shaft 123 if the latter is not ferromagnetic. A circlip 128 located in a circumferential groove on shaft 123 engages an end of the bushing 126 to limit forward extension.

As in the previous embodiment, the roller 80 is rollingly captive in the intermediate wide channel 32*a* of rigid planar element 30 which is bonded to front glass panel 2*a* with double sided compressive foam adhesive tape.

It may be mentioned that many of the aluminium extrusions described above with reference to the accompanying drawings are standard aluminium extrusions available from Click Systems Limited, Mississauga, Ontario, Canada.

I claim:

1. A cabinet having sides and an opening at the front, a glass panel, and movable linkage means connecting between the sides of the cabinet and the glass panel for movement of the panel between a position closing the opening and a position revealing the opening, said linkage means including a rigid metal planar element bonded on the inner side of the glass panel with a double sided adhesive tape comprising a resiliently compressible core and a pressure sensitive adhesive coating on each face and providing sufficient strength to support the weight of the glass panel.

2. A cabinet according to claim 1, wherein said core is an acrylic foam.

3. A cabinet according to claim 1, wherein the rigid metal element is an aluminum extrusion.

4. A cabinet according to claim 3 having:

at least eight parallel edge strips extending along vertical edges of the cabinet, said adhesive tape bonding said edge strips together in pairs along a 45° angle from the first axis of the cabinet whereby to form at least four 90° corner edges; and a lower frame disposed horizontally at the lower end of the cabinet and being connected to the sides of the cabinet and to said glass panel.

5. A cabinet according to claim 4, wherein the frame comprises at least four struts extending between said pairs of edge strips and each strut coupled at its respective ends to an adjoining strut to form a closed figure.

6. A cabinet according to claim 4, wherein the first frame further comprises:

a hinge member constituting said linkage means mounted along the length of a front edge of the frame; and said rigid metal planar element bonded with said adhesive tape along one straight edge of one of said at least one glass panels, said element being mounted on the hinge member, whereby to permit said glass panel to swing open from said cabinet.

7. A cabinet according to the claim 4, including an upper frame connected to the cabinet sides, a second rigid metal planar element bonded on the inner side of the movable glass panel adjacent its top, a forwardly and rearwardly independently slidable support connected on each frame and a transversely slidable support connected between each forwardly and rearwardly slidable support and the adjacent planar element, to allow the cabinet to be opened by sliding the glass panel across said forwardly and rearwardly slidable support when extended outwardly of the cabinet.

8. A cabinet according to claim 7, wherein the sides of the cabinet are permanently inset into a wall.

9. A cabinet according to claim 7, wherein each planar element has, defined along its length, a channel opening inwardly into the cabinet, and each transversely slidable support comprises at least two rollers mounted, in spaced relation, on the forwardly and rearwardly slidable support and engageable in the channel.

10. A cabinet according to claim 9, wherein each roller comprises a central axle and a tread with a ball-bearing mount between the tread and the axle and the tread is capable of limited lateral rocking movement relative to its plane of rotation about the axle.

11. A cabinet according to claim 7, wherein each base frame further comprises parallel second and third rigid planar elements, each having a channel opening inwardly into the cabinet defined along its length, and wherein the forwardly and rearwardly slidable support comprises two rollers, mounted in spaced relation along the outer face of each of two opposed rigid members connecting to and mounting said first-mentioned rollers, and engageable in the channel of the adjacent rigid planar element; and stop means for limiting sliding movement of the rigid members forwardly relative to said second and third planar elements.

12. A cabinet according to claim 11, wherein the foremost of each said two rollers is mounted on an axle passing eccentrically through a cylindrical mount rotationally adjustable from an inner side of the rigid member, whereby to adjust the height of the roller relative to the rigid member.

13. A cabinet according to claim 11, wherein each said rigid member is biased to a closed position.

14. A cabinet according to claim 1, wherein the linkage means comprise:

said first-mentioned and a second rigid metal planar element bonded along opposite straight edges of said glass panel respectively, having defined along its length a channel opening inwardly into the cabinet;

at least two rollers, mounted in laterally spaced relation and receivable in said channel of each planar element for laterally slidable mounting of said glass panel on said bases, each roller comprising a tread mounted on a forwardly and rearwardly extensible shaft, whereby the glass panel may be moved forwardly outwardly from said cabinet; and stop means for limiting forward extension of said axle.

15. A cabinet according to claim 14, wherein at least one shaft is biased to a retracted position by a magnet acting between the shaft and the back wall of the cabinet.

* * * * *